US007156031B2

(12) United States Patent
Mermier et al.

(10) Patent No.: US 7,156,031 B2
(45) **Date of Patent: *Jan. 2, 2007**

(54) WIDE PLEASURE BOAT OR CRUISE SHIP

(75) Inventors: Laurent Mermier, 32, rue Galilée, 44100 Nantes (FR); Joel Bretecher, 1 allée des Etangs- La Joallière, 44800 Sautron (FR)

(73) Assignees: Laurent Mermier, Nantes (FR); Joel Bretecher, Sautron (FR); Chantiers de l'Atlantique, Paris (FR)

( * ) Notice: Subject to any disclaimer, the term of this patent is extended or adjusted under 35 U.S.C. 154(b) by 0 days.

This patent is subject to a terminal disclaimer.

(21) Appl. No.: 10/268,686

(22) Filed: Oct. 11, 2002

(65) Prior Publication Data

US 2003/0075090 A1 Apr. 24, 2003

(30) Foreign Application Priority Data

Oct. 23, 2001 (FR) ..... 01 13652
Jan. 4, 2002 (FR) ..... 02 00063

(51) Int. Cl.

| | |
|---|---|
| ***B63B 1/00*** | (2006.01) |
| ***B63B 3/00*** | (2006.01) |
| ***B63B 15/00*** | (2006.01) |
| ***B63B 29/02*** | (2006.01) |
| ***B63B 35/44*** | (2006.01) |

(52) U.S. Cl. ..... 114/56.1; 114/65 R

(58) Field of Classification Search ..... 114/56.1, 114/65 R, 66, 382, 61.1–63, 258–266, 72, 114/85, 44–51

See application file for complete search history.

(56) References Cited

U.S. PATENT DOCUMENTS

| | | | | |
|---|---|---|---|---|
| 1,038,176 | A * | 9/1912 | Millican | 114/65 R |
| 1,088,239 | A | 2/1914 | Paine | |
| 1,333,580 | A * | 3/1920 | Salas | 114/45 |
| 2,076,957 | A | 4/1937 | Lueck | |
| 2,233,240 | A * | 2/1941 | Boldis et al. | 114/68 |
| 2,711,707 | A * | 6/1955 | Seitzman | 114/321 |
| 2,892,435 | A * | 6/1959 | Ljungstrom | 114/122 |
| 2,966,779 | A | 1/1961 | Lintern et al. | |
| 3,630,163 | A * | 12/1971 | Williams | 114/85 |
| 3,661,114 | A * | 5/1972 | Wagner et al. | 440/12.52 |
| 3,739,410 | A * | 6/1973 | Fortin | 114/345 |
| 3,842,771 | A * | 10/1974 | Murata | 114/61.31 |
| 4,046,092 | A * | 9/1977 | Tornqvist | 114/61.31 |
| 4,223,623 | A * | 9/1980 | Brunet et al. | 114/77 R |

(Continued)

FOREIGN PATENT DOCUMENTS

DE 3237827 A1 * 4/1983

(Continued)

OTHER PUBLICATIONS

Translation of JP 11-334697 A.*

(Continued)

*Primary Examiner*—Ajay Vasudeva
(74) *Attorney, Agent, or Firm*—Sughrue Mion, PLLC

(57) ABSTRACT

A cruise ship or pleasure boat is disclosed that has an open or semi-open main public space situated around the axial longitudinal plane of the ship and at the base of port and starboard longitudinal superstructures. The port and starboard longitudinal superstructures that border the public space are inclined away from the axial longitudinal plane of the ship so that the ratio of the width of the combination comprising the longitudinal superstructures and the public space to the width of the ship at the waterline is from 1.3 to 3.

19 Claims, 4 Drawing Sheets

U.S. PATENT DOCUMENTS

| | | | | |
|---|---|---|---|---|
| 4,838,190 | A * | 6/1989 | Levander | 114/56.1 |
| 6,755,143 | B1 * | 6/2004 | Mermier et al. | 114/65 R |
| 2003/0075092 | A1 | 4/2003 | Mermier et al. | |

FOREIGN PATENT DOCUMENTS

| | | | | |
|---|---|---|---|---|
| EP | 37843 | A1 | * | 10/1981 |
| EP | 790179 | A1 | * | 8/1997 |
| FR | 475 099 | | | 4/1915 |
| FR | 2 478 017 | A | | 9/1981 |
| FR | 2834687 | A1 | * | 7/2003 |
| GB | 1 297 245 | A | | 11/1972 |
| GB | 2 083 415 | A | | 3/1982 |
| GB | 2 103 550 | A | | 2/1983 |
| JP | 52125582 | A | * | 10/1977 |
| JP | 54059778 | A | * | 5/1979 |
| JP | 54059779 | A | * | 5/1979 |
| JP | 54059780 | A | * | 5/1979 |
| JP | 55063992 | A | * | 5/1980 |
| JP | 61207292 | A | * | 9/1986 |
| JP | 61211192 | A | * | 9/1986 |
| JP | 62244789 | A | * | 10/1987 |
| JP | 02164687 | A | * | 6/1990 |
| JP | 03266791 | A | * | 11/1991 |
| JP | 05221381 | A | * | 8/1993 |
| JP | 08254346 | A | * | 10/1996 |
| JP | 11334697 | A | * | 12/1999 |
| JP | 2001301686 | A | * | 10/2001 |

OTHER PUBLICATIONS

Translation of JP 61-207292 A.*
Translation of JP 54-059778 A.*
Translation of FR 2834687 A1.*

* cited by examiner

WIDE PLEASURE BOAT OR CRUISE SHIP

BACKGROUND OF THE INVENTION

1. Field of the Invention

The present invention concerns a wide pleasure boat or cruise ship of the kind having an open or semi-open main public space bordered by longitudinal superstructures.

In the present description and in the claims:

the expression "main public space" designates a space of substantial size comprising one or more areas dedicated primarily to the use of passengers;

the expression "open main public space" designates a main public space which is open to the outside, primarily at the top;

the expression "semi-open main public space" designates an open main public space to which one or more fixed or mobile elements have been added, primarily at the top, whose function is to keep out sun, wind and inclement weather;

the expressions "length" and "width" respectively designate the dimension in the longitudinal direction of the ship (normal direction of forward movement) and the dimension in the transverse direction of the ship;

the expression "set of superstructures" designates the portion of the ship situated above the mean level of the compartmentalization deck, which deck covers the watertight compartmentalization bulkheads;

the expression "longitudinal superstructure" designates a substantial portion of the set of superstructures whose length is greater than the width; and the expression "classically proportioned quickwork" designates quickwork for which the ratio of the length at the waterline to the width at the waterline is from 4 to 10, as in most present-day ferries and pleasure boats.

2. Description of the Prior Art

Cruise ships and pleasure boats (large yachts) are usually single-hull vessels with decks whose width is identical or close to the width of the ship at the waterline. The open or semi-open public spaces are generally on the upper decks. To meet an ever increasing demand to increase the density of cabins and other areas giving onto the outside, some ship designs have a longitudinal main public space bordered by port and starboard vertical longitudinal superstructures primarily accommodating cabins with an outside view, either toward the sea if they are on the side away from the axis of the ship or toward the main public space in question if they are on the side near the axis of the ship. These ship designs have a total width equal to or close to their width at the waterline. If the ship is a single-hull vessel, its substantially U-shaped cross section cannot provide a volume of air above the main public space wide enough for the public space and the cabins and other areas giving onto it to be user-friendly, pleasant and sufficiently sunny. Widening the entire ship is not advantageous, in particular because of uncomfortable rolling (the natural period of rolling of the ship would become too short); this problem can be solved by producing a multiple-hull ship, which has other drawbacks such as the high cost of building the underwater portions.

The present invention aims to avoid the above problems by using a new design principle which provides many outdoor spaces or spaces giving onto the outdoors that are user-friendly and functional but satisfy comfort and safety requirements.

SUMMARY OF THE INVENTION

In a ship according to the present invention, of the kind having an open or semi-open main public space situated around the axial longitudinal plane of the ship and at the base of port and starboard longitudinal superstructures, the port and starboard longitudinal superstructures that border the public space are inclined away from the axial longitudinal plane of the ship so that the width of the combination comprising the longitudinal superstructures and the public space is significantly greater than the width of the ship at the waterline, the ratio of the width of the combination comprising the longitudinal superstructures and the public space to the width of the ship at the waterline being from 1.3 to 3, and preferably from 1.6 to 2.5. This increases the transverse inertia of the ship, which makes it roll more slowly and makes its rolling characteristics less sensitive to short-period swell. Moreover, the volume above the public space is made larger, the public space becomes more user-friendly and functional, and the areas situated in the longitudinal superstructures and giving onto the public space become more pleasant. Moving the two superstructures farther apart reduces the risk of a fire propagating from one superstructure to the other. The ship is advantageously of the single-hull type. The quickwork of the ship is classically proportioned, meeting comfort, stability and drag requirements. The dimensions and mass of the longitudinal superstructures are similar to facilitate transverse balancing of the ship, but the longitudinal superstructures need not be exactly symmetrical. The expression "widened assembly" refers to the assembly comprising the public space and the port and starboard longitudinal superstructures that border it. The ship can have one or more widened assemblies.

In the area of the widened assembly, the resistance to longitudinal flexing of the ship beam can be provided either by the combination of the hull and the superstructures or only by the portion of the ship to which the longitudinal superstructures are attached, the latter being decoupled longitudinally by sliding joints. The transverse resistance of the ship to rolling (known as the "racking" resistance) can be provided by a large number of transverse structural bulkheads in the hull and in the longitudinal superstructures, and transverse horizontal beams can be connected from the top of one longitudinal superstructure to the other.

It is advantageous to dedicate the port and starboard structures that border the public space primarily to passenger cabins, so that all cabins give onto the outside, some cabins having the benefit of a sea view and others having the benefit of a view onto the public space. Passenger cabins are also arranged along the inclined inboard facade of the port and starboard superstructures such that a distance between the axial longitudinal plane of the ship and the inboard walls of the cabins is greater at the top of the superstructure than at the base of the superstructure. The horizontal circulation of the air conditioning trunking can be grouped together at a single level, the cabins situated in these superstructures on a different deck being fed with conditioned air from this level by vertical trunking in groups of two to four. This simplifies the design, construction and erection of these areas. In particular, it is practical to fabricate prefabricated cabin elements into which vertical air conditioning trunking is integrated (and even water pipes, electrical cables, etc.).

The ship according to the invention can have an approximately V-shaped or Y-shaped cross section, the port and starboard longitudinal superstructures having a transverse overall inclination. This overall inclination imparts to the public space at the base of the longitudinal superstructures a sunny aspect and creates an impression of terraces.

In a first embodiment, the hull of the ship according to the invention flares rapidly above the waterline, with a mean angle to the vertical of at least 25°, the longitudinal superstructures that border the main public space being situated close to each side of the flared hull. In the event of invasion by water, the overall shape of the ship increases the width at the waterline as the ship settles, and thus significantly improves the stability of the ship, which depends directly on the transverse inertia at the waterline.

In a second embodiment, the width of the hull of the ship according to the invention does not increase much or at all above the flotation line, the mean angle between the edge of the hull and the vertical being less than 25°, the longitudinal superstructures that border the public space being situated close to the side on a superstructure situated on the hull, at least 2.5 meters high and significantly wider than the ship at the flotation line. This configuration enables the ship to be designed with a relatively simple longitudinal structure.

In the ship according to the invention, at least the aft two thirds of all of the superstructures consist of one or more public spaces bordered by longitudinal superstructures, the forward part consisting of an enclosed area extending over the whole of the width. This area can be dedicated primarily to public spaces, cruise spaces and the wheelhouse. The center of gravity of the ship is thus positioned significantly further forward than in a conventional cruise ship or pleasure boat. Making the quickwork more bulky in the forward third, but not wider, balances the trim of the ship, without moving forward the center of inertia at the waterline. The longitudinal offsetting of the center of gravity relative to the center of inertia at the waterline is a factor improving the pitching behavior of the ship with some kinds of swell.

The accompanying drawings illustrate the invention.

DETAILED DESCRIPTION OF THE PREFERRED EMBODIMENTS

Figure 1:
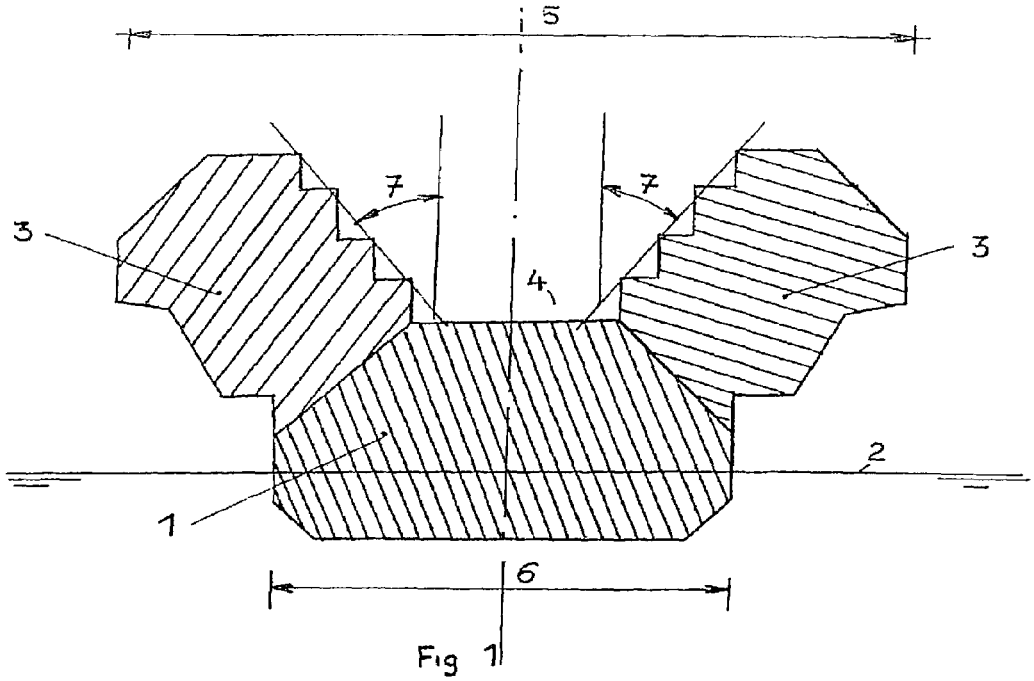
FIG. 1 shows in cross section a design principle of a ship according to the invention.

Referring to the drawings, the ship has a main structure 1 whose portion below the waterline 2 constitutes the quickwork. An open or semi-open main public space 4 is situated on the main structure 1. The ship has port and starboard longitudinal superstructures 3 which border the public space and which are far away from the axial longitudinal plane of the ship so that the ratio of the width 5 of the combination comprising the longitudinal superstructures 3 and the public space to the width 6 of the ship at the waterline is from 1.3 to 3 and preferably from 1.6 to 2.5. For increased sunshine, the inboard facade of the superstructures can have a mean rake angle 7 from 3° to 50° and preferably from 5° to 35°.

Figure 2:
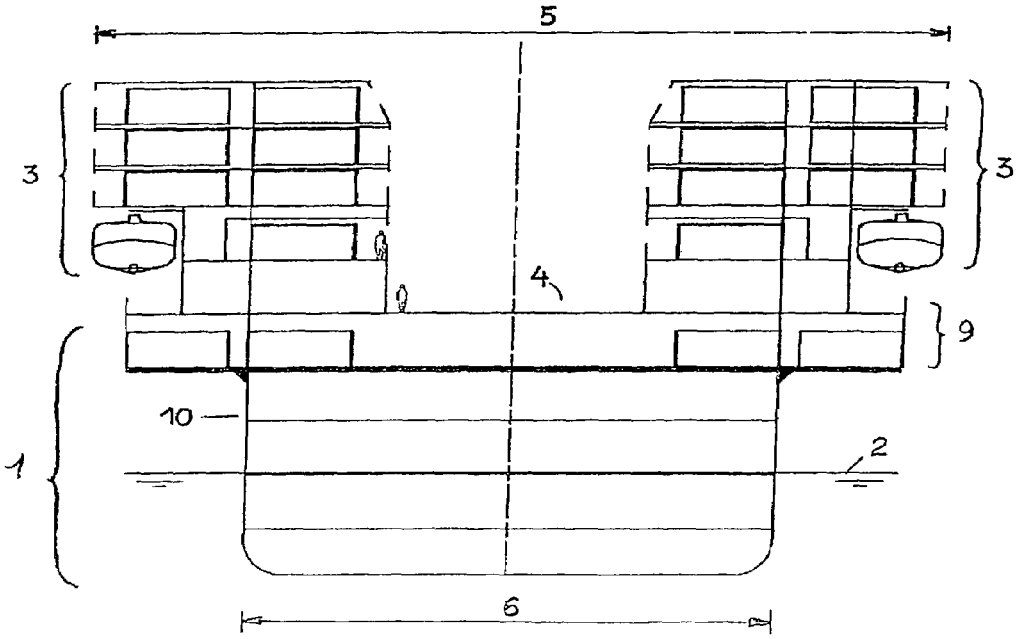
FIG. 2 shows a variant of the above principle in more detailed cross section.

Referring to FIG. 2, the ship can have a hull whose width 10 does not increase much or at all above the waterline, the mean angle between the edge of the hull and the vertical being less than 25°, the longitudinal superstructures 3 that border the public space being situated close to the side on a superstructure 9 situated on the hull, at least 2.5 meters high and significantly wider than the width 6 of the ship at the waterline.

Figure 3:
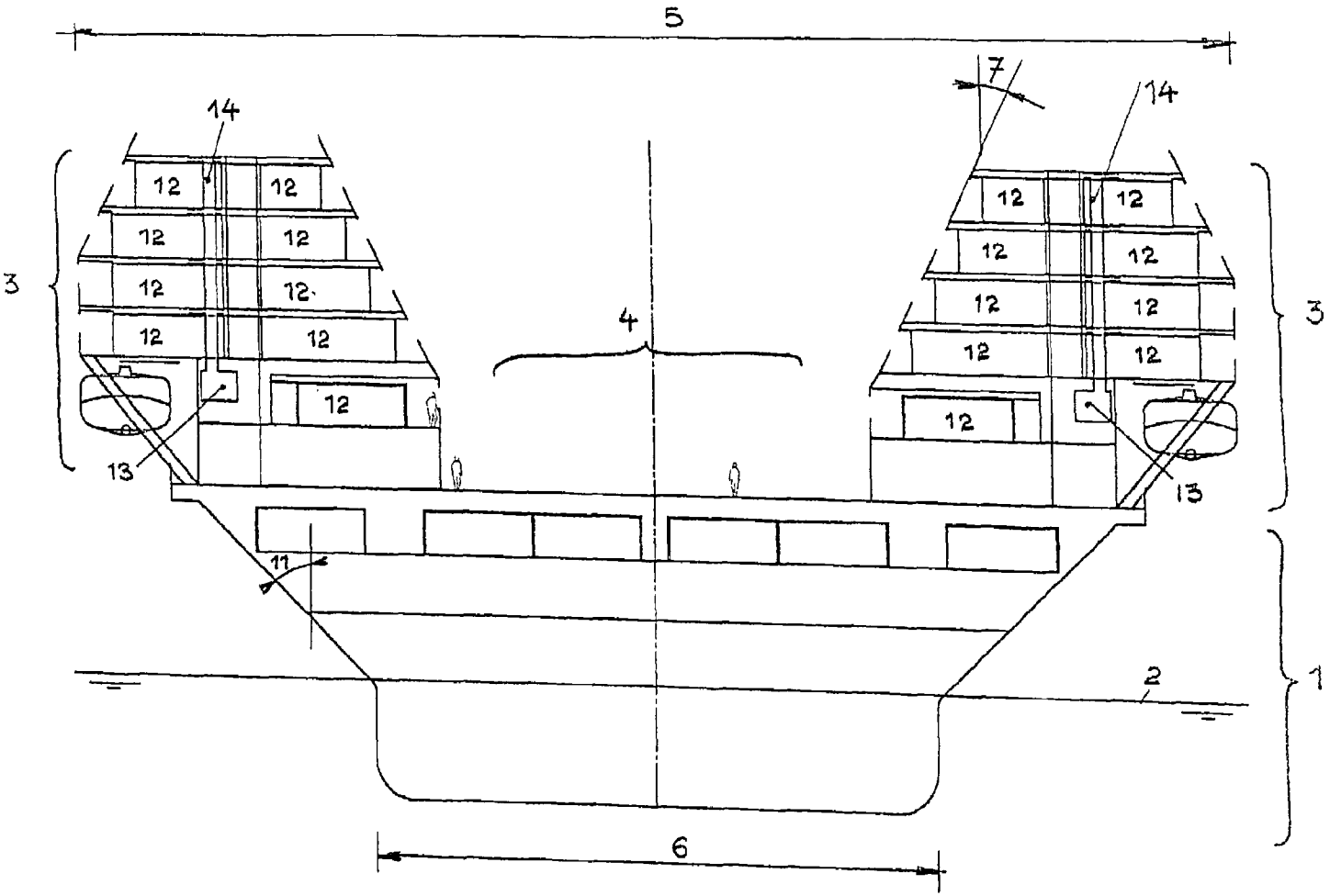
FIG. 3 shows another variant of the principle in cross section.

Referring to FIG. 3, the hull of the ship can flare rapidly above the waterline, with a mean angle 11 relative to the vertical of at least 25°; the port and starboard longitudinal structures 3 can have a transverse overall inclination which makes the lower main public space 4 sunnier and substantially increases the width of the widened assembly above the waterline 2. The longitudinal superstructures 3 can be primarily dedicated to passenger cabins 12 giving onto the outside. Passenger cabins are also arranged along the inclined inboard facade of the port and starboard superstructures such that a distance between the axial longitudinal plane of the ship and the inboard walls of the cabins is greater at the top of the superstructure than at the base of the superstructure. In the case of this ship concept, the horizontal circulation of the air conditioning trunking 13 can be grouped together at a single level, the cabins situated in these superstructures on a different deck being fed with conditioned air from this level by vertical trunking 14 in groups of two to four.

Figure 4:
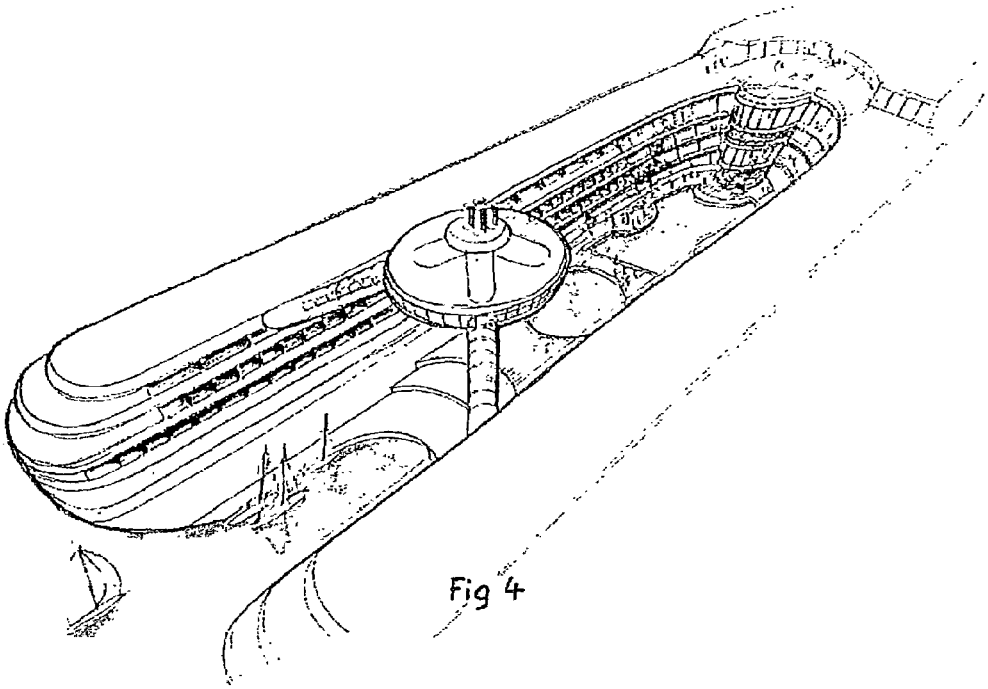
FIGS. 4, 5, 6 and 7 each represent a rear perspective view of a non-limiting example of a ship according to the invention.

FIG. 4 shows a ship according to the invention which has a widened assembly, a marina at the stern, an full-width enclosed forward area, and a panoramic saloon above the marina.

Figure 5:
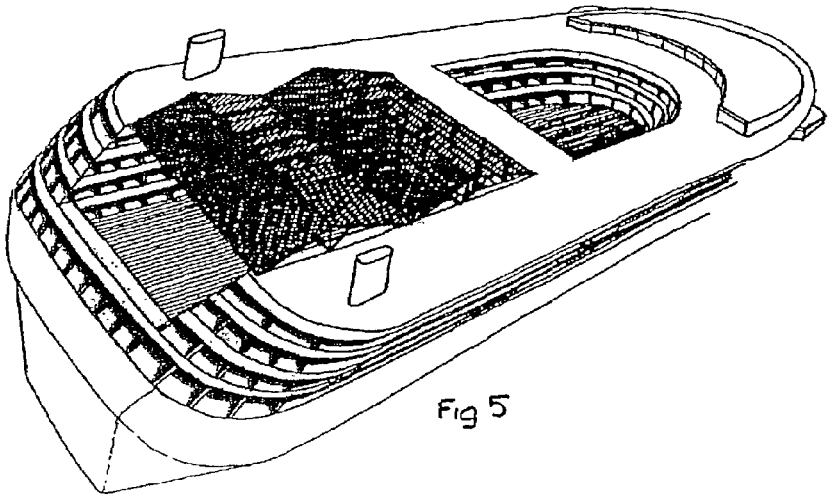

FIG. 5 shows a ship according to the invention which has two widened assemblies separated from each other by an enclosed transverse superstructure. The aft widened assembly is protected from sun and wind by a stretched canvas awning. The aft end of the widened space is protected by a low transverse enclosed superstructure.

Figure 6:
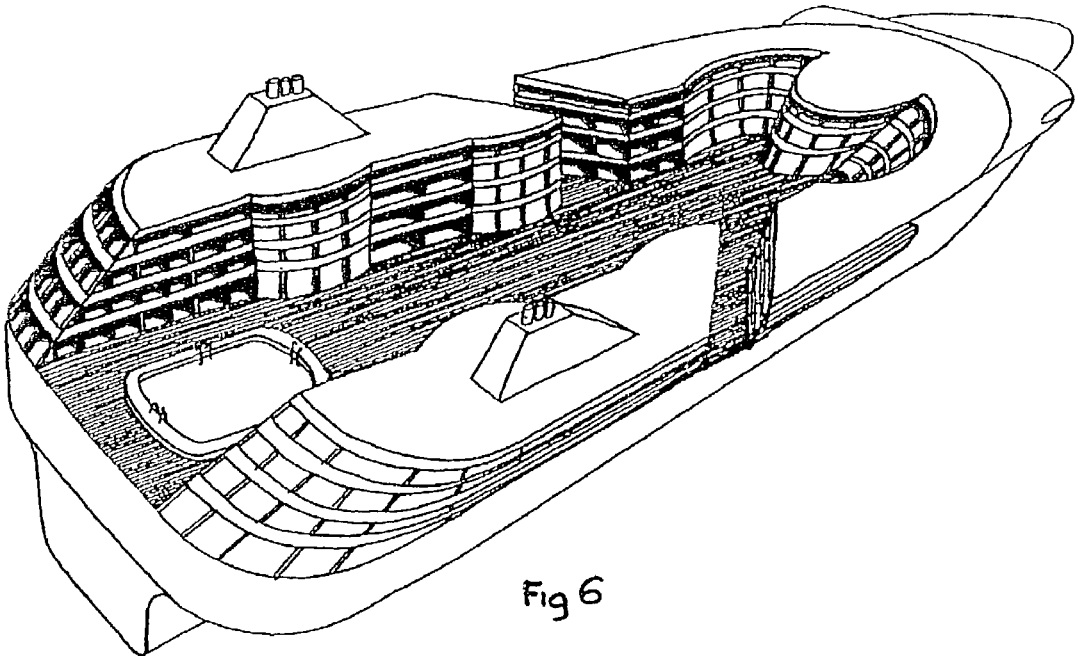

FIG. 6 shows a ship according to the invention which has two separate longitudinal superstructures on each of the port and starboard sides.

Figure 7:
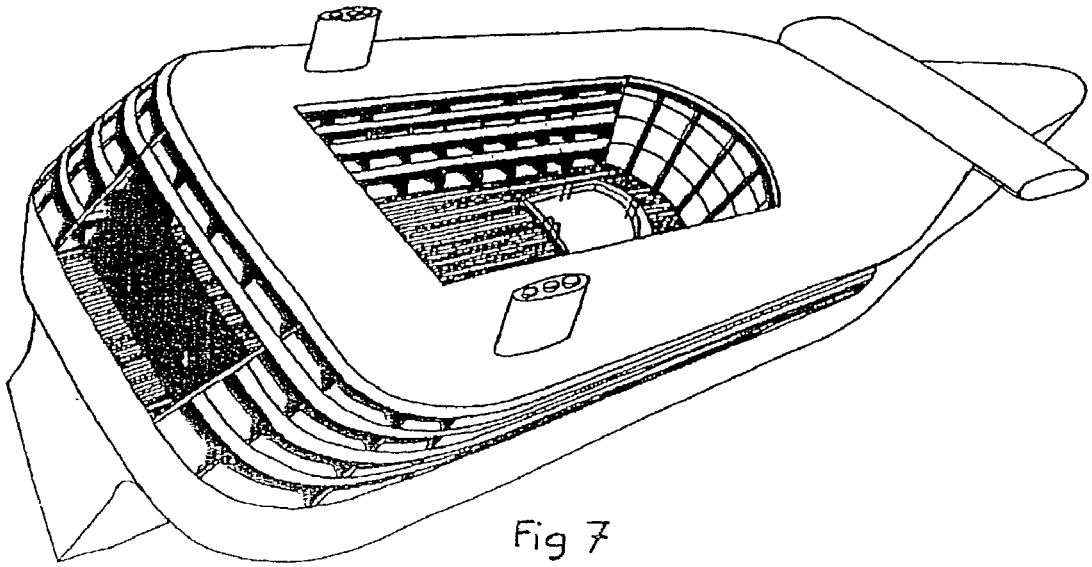

FIG. 7 shows a ship according to the invention which has a widened assembly at the stern and an enclosed forward superstructure whose width is similar to the width at the waterline. A rear transverse deck connects the two longitudinal superstructures.

The ship can be built using materials and equipment routinely used in the construction of cruise ships and pleasure boats.

To give a non-limiting example, the ship can have a width at the waterline of 32 meters and an overall width of 58 meters, with an overall length of 250 meters. The longitudinal superstructures and the main public space can extend over the aft three quarters of the ship, the forward quarter constituting a full-width enclosed area dedicated to public spaces and to the wheelhouse. The aft portion of this enclosed area, which links the port and starboard longitudinal superstructures, can consist of terraces which produce the overall effect of an amphitheater. The stern of the ship can be a marina.

To give another non-limiting example, the ship can have a width at the waterline of 13 meters and an overall width of 20 meters, with an overall length of 100 meters. The widened assembly can extend over the aft third of the ship, the forward two-thirds consisting of an enclosed area with a maximum width of 13 meters, dedicated to public spaces and to the wheelhouse. The aft end of the ship can be closed by a transverse superstructure slightly lower than the port and starboard longitudinal superstructures.

The ship according to the invention is particularly intended for tourist class cruises.

The invention claimed is:

1. A ship comprising an open or semi-open main public space situated around an axial longitudinal plane of said ship and at a base of each of port and starboard longitudinal superstructures, wherein said port and starboard longitudinal superstructures bordering said public space are disposed away from said axial longitudinal plane of said ship, each longitudinal superstructure is transversely inclined away from said axial longitudinal plane and said public space, each longitudinal superstructure comprising cabins wherein inboard walls of said cabins bordering said public space are arranged along an inclined inboard facade of each superstructure, wherein a distance between the axial longitudinal plane and the inboard walls of said cabins is greater at the top of each superstructure than at the base of each superstructure, and said ship's hull flares rapidly above its waterline with a mean angle relative to the vertical of at least 25°.

2. The ship claimed in claim 1, wherein said ship comprises a single hull.

3. The ship claimed in claim 1, wherein a ratio of a width of a combination comprising said longitudinal superstructures and said public space to a width of said ship at the waterline is from 1.3 to 3.

4. The ship claimed in claim 1, wherein a mean rake angle of an inboard facade of said port and starboard longitudinal superstructures is from 3° to 50°.

5. The ship claimed in claim 1, wherein a mean rake angle of an inboard facade of said port and starboard longitudinal superstructures is from 5° to 35°.

6. The ship claimed in claim 1, wherein at least the aft two-thirds of said ship comprises one or more public spaces bordered by said longitudinal superstructures, and the forward portion of said ship comprises an enclosed area over a width of said ship.

7. The ship claimed in claim 1, wherein the upper decks of said port and starboard superstructures that border said public space are primarily dedicated to passenger cabins giving onto the outside.

8. The ship claimed in claim 7, wherein the horizontal circulation of an air conditioning trunking is grouped together at a single level, the cabins situated in said superstructures on a different deck being fed with conditioned air from this level by vertical trunking in groups of two to four.

9. The ship claimed in claim 1, further comprising a traverse deck connecting said port and starboard longitudinal superstructures.

10. The ship claimed in claim 1, wherein a ratio of a width of a combination comprising said longitudinal superstructures and said public space to a width of said ship at the waterline is from 1.6 to 2.5.

11. A ship comprising an open or semi-open main public space situated around an axial longitudinal plane of said ship and at a base of each of port and starboard longitudinal superstructures, wherein said port and starboard longitudinal superstructures bordering said public space are disposed away from said axial longitudinal plane of said ship, each longitudinal superstructure comprising cabins wherein inboard walls of said cabins bordering said public space are arranged along an inclined inboard facade of each superstructure, wherein a distance between the axial longitudinal plane and the inboard walls of said cabins is greater at the top of each superstructure than at the base of each superstructure.

12. The ship claimed in claim 11, wherein a ratio of a width of a combination comprising said longitudinal superstructures and said public space to a width of said ship at the waterline is from 1.3 to 3.

13. The ship claimed in claim 11, wherein a mean rake angle of an inboard facade of said port and starboard longitudinal superstructures is from 3° to 50°.

14. The ship claimed in claim 11, wherein at least the aft two-thirds of said ship comprises one or more public spaces bordered by said longitudinal superstructures, and the forward portion of said ship comprises an enclosed area over a width of said ship.

15. The ship claimed in claim 11, wherein upper decks of said port and starboard superstructures that border said public space are substantially dedicated to passenger cabins.

16. The ship claimed in claim 11, further comprising a traverse deck connecting said port and starboard longitudinal superstructures.

17. The ship claimed in claim 16, wherein the horizontal circulation of an air conditioning trunking is grouped together at a single level, the cabins situated in said superstructures on a different deck being fed with conditioned air from this level by vertical trunking in groups of two to four.

18. The ship claimed in claim 11, wherein said ship comprises a single hull.

19. The ship claimed in claim 11, wherein a ratio of a width of a combination comprising said longitudinal superstructures and said public space to a width of said ship at the waterline is from 1.6 to 2.5.

* * * * *